US005884499A

United States Patent [19]

Samborn et al.

[11] Patent Number: 5,884,499

[45] Date of Patent: Mar. 23, 1999

[54] CHILLED CONDIMENT DISPENSER

[75] Inventors: Michael R. Samborn, Atlanta; William Randolph Dudley, Jr., Lawrenceville, both of Ga.

[73] Assignee: Kraft Foods, Inc., Northfield, Ill.

[21] Appl. No.: 905,273

[22] Filed: Aug. 6, 1997

[51] Int. Cl.[6] ..... A47F 3/04

[52] U.S. Cl. ..... 62/252; 62/457.2; 312/35; 312/42

[58] Field of Search ..... 62/246, 252, 457.1, 62/457.2; 312/35, 36, 42, 280

[56] References Cited

U.S. PATENT DOCUMENTS

| | | | |
|---|---|---|---|
| 670,555 | 3/1901 | Cobb | 312/42 |
| 1,023,116 | 4/1912 | Bailey | 312/36 |
| 1,693,231 | 11/1928 | Gruber | 312/42 |
| 2,443,871 | 6/1948 | Shield | 211/71 |
| 3,006,707 | 10/1961 | Rossi | 62/252 |
| 3,010,290 | 11/1961 | Fredrick | 62/251 |
| 3,314,250 | 4/1967 | Weber | 312/36 |
| 3,437,238 | 4/1969 | Luba | 221/129 |
| 3,643,808 | 2/1972 | Ryan et al. | 211/49 D |
| 3,990,752 | 11/1976 | Hoffmann et al. | 312/118 |
| 4,319,629 | 3/1982 | Hotta | 62/457.2 |
| 4,401,223 | 8/1983 | Spamer | 211/134 |
| 5,072,997 | 12/1991 | Mayfield, III | 312/35 |

OTHER PUBLICATIONS

Pending U.S. Pat. App. No. 08/907,246 Samborn, et al. Filed Aug. 6, 1997.

Pending U.S. Pat. No. 08/906993 Samborn, et al. Filed Aug. 6, 1997.

Pending U.S Design Pat. App. No. 29/074745 Samborn, et al. Filed Aug. 6, 1997.

Two pages of advertising information showing Modular Series 1200, 5500, 5600, 5700 and 9000 of Condiment Dispensers or Organizers.

One page of advertising information showing Cal●Mil acrylic bulk food bins or dispensers.

*Primary Examiner*—William E. Tapoicai

*Attorney, Agent, or Firm*—Fitch, Even, Tabin & Flannery

[57] ABSTRACT

A self-serve chilled condiment dispenser dispenses individual containers of one or more different types of condiments from a compact space generally on a first in, first out basis. The chilled condiment dispenser comprises a cabinet having a narrow side compartment for housing one or more removable cooling devices, and a plurality of removable chutes stacked one above the other. The cooling devices may be removed from the dispensers without having to remove condiment containers.

17 Claims, 2 Drawing Sheets

CHILLED CONDIMENT DISPENSER

BACKGROUND OF THE INVENTION

1. Field of the Invention

The invention relates generally to condiment dispensers, and more particularly to dispensers for individual containers of chilled condiments.

2. Background and Description of Related Art

Condiments, including, e.g., cream cheese, butter, margarine, dairy creamers, jellies, jams, mayonnaise, mustard, and the like, are often packaged individually in small, disposable containers for use by the consumer. Certain condiments require refrigeration to preserve freshness, to prevent softening, or for other reasons.

There is a need for an improved dispensing apparatus for chilled condiments. Known dispensing arrangements for such products tend to be rather bulky, and may take up unduly great amounts of counter space, which may be limited. Certain dispensing arrangements for chilled condiments may present sanitation concerns where they involve direct contact between condiment containers and ice, ice packs or other cooling devices. Further, with these dispensing arrangements, it is generally not possible to remove the cooling devices from the dispensers without also removing the condiments therefrom. Such dispensers also may dispense condiments generally on a first in, last out basis.

In the past, dispensing of condiments that require refrigeration has in some cases involved use of a cooling material, such as ice, in direct contact with the condiment containers at the dispensing location or, alternatively, has involved the condiment containers being kept in a refrigerator until shortly before dispensing, then placed in a dispensing location in small numbers, with the product being replenished frequently as it is used.

It is a general object of the invention to provide an improved chilled condiment dispensing apparatus which may be suitable for use in, e.g., cafeterias, convenience stores, and/or vending areas where counter space is limited, and compactness is highly desirable.

A further object of the invention is to provide a chilled condiment dispenser which is simple and easy to use, both from the standpoint of the consumer who is receiving product from the dispenser, as well as from the standpoint of persons responsible for setup, filling, removal of unused product for storage, and cleaning of the dispenser.

Additional objects and advantages of the invention are set forth hereinbelow and are shown in the accompanying drawings.

SUMMARY OF THE INVENTION

The present invention provides a compact self-serve chilled condiment dispenser for cooling and dispensing individual containers of one or more different types of chilled condiments.

The dispenser of the present invention has a plurality of chutes or trays for containing individual containers of condiment products (preferably one for each different type of condiment to be dispensed). The chutes are stacked in a cabinet or housing and sloped downward toward the front of the cabinet, with each chute having its forward end aligned with an opening in the front of the cabinet to provide easy access by consumers to product contained within the chute. At its upper, rear end, each chute is open to enable refilling of product conveniently and quickly. Each of the chutes may be separately removed from the chilled condiment dispenser while condiments are present therein to facilitate overnight refrigerated storage of the condiments.

In accordance with the invention, the chilled condiment dispenser has a narrow, compact side compartment disposed along at least one side of the cabinet, and has one or more removable cooling devices, such as ice packs, ice cubes, dry ice, liquid cooling agents or the like, or a combination thereof, disposed therein. This allows the cooling devices to be removed from the dispenser without removal of condiments, and vice versa. This feature also allows the cooling devices to be maintained in the dispenser in a compact manner, thereby reducing the counterspace necessary for supporting the dispenser.

To enable heat transfer between the interiors of the condiment chutes and the cooling devices, each of the chutes preferably comprises a thermally conductive material, such as an aluminum composite material, which conducts heat from the chute interior to the side compartments, whereas the exterior cabinet walls preferably comprise thermally insulative materials.

The side compartment preferably extends the full height and depth of the housing to provide efficient cooling along one side of substantially the entire length of each of the condiment chutes. Thus, condiments may be maintained at a sub-ambient temperature without direct contact between cooling devices and the condiment containers.

Each of the cooling devices preferably comprises a container having a coolant material therein, such as an ice pack, and preferably has a handle at its upper end to enable the cooling device to be manually inserted into, and removed from, the side compartments of the cabinet from above without requiring clearance between the cooling device and the interior of the side compartments.

To facilitate removal of condiment containers remaining in the trays at the end of a period of use, for refrigerated overnight storage or the like, each of the chutes is removable from the cabinet with the condiment containers supported therein. To prevent the condiment containers from spilling out at the front end of the chute as it is removed, there is provided a sliding closure which may be inserted along the inside of the front wall of the cabinet and slid downward across the open front of each chute, then held in place as the chute is raised so that the open front end or mouth of the chute may be slid upward along the surface of the closure until the chute is no longer sloping forward, at which point product spillage from the open front of the chute is no longer of concern.

The closure is preferably a thin, rectangular plate which serves as a cover or lid for the cabinet during dispensing, and which has a width slightly less than the distance between the side walls of the cabinet to permit it to perform the above-described function.

The dispenser of the present invention advantageously provides product rotation and freshness by dispensing condiment containers generally on a first in, first out basis, in that condiment containers loaded into the dispenser (through the rear ends of the chutes) will be accessible by consumers generally in the order they are loaded. However, because a plurality of condiment containers are made available to consumers through each opening in the front wall of the dispenser, consumers will advantageously have the ability to select one or more condiment containers from a plurality of condiment containers at each opening, rather than being required to select containers strictly on a first-in, first-out basis.

DETAILED DESCRIPTION OF PREFERRED EMBODIMENTS

Figure 1:
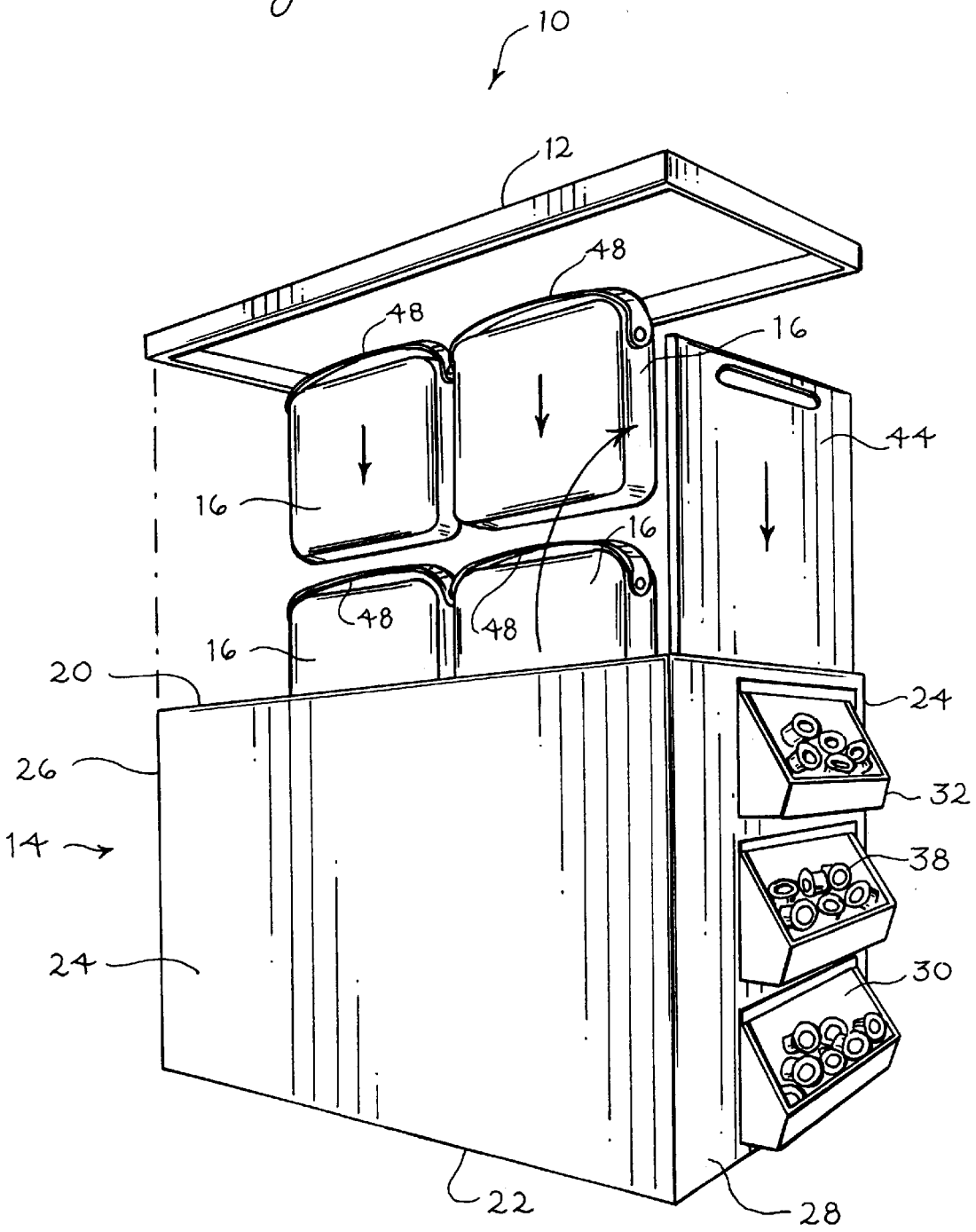
FIG. 1 is a perspective view of a preferred chilled condiment dispenser of the invention.

The present invention provides a self-serve dispenser which has the ability to cool and dispense a large number of individual containers of one or more different types of condiments from a compact space generally on a first in, first out basis. The dispenser allows the insertion therein, and removal therefrom, of cooling devices without requiring removal of the chilled condiment containers therefrom, and vice versa.

Specific dispensers within the scope of the invention include, but are not limited to, the dispenser discussed in detail herein and/or illustrated in the drawings contained herein.

Contemplated equivalents of the chilled condiment dispenser described herein and/or illustrated in the drawings contained herein include chilled condiment dispensers which otherwise correspond thereto, and which have the same general properties, components and/or features thereof.

A preferred embodiment of the invention will now be described with reference to the drawings. In the drawings, like reference symbols indicate the same parts of the chilled condiment dispensers throughout the four different views thereof.

Figure 4:
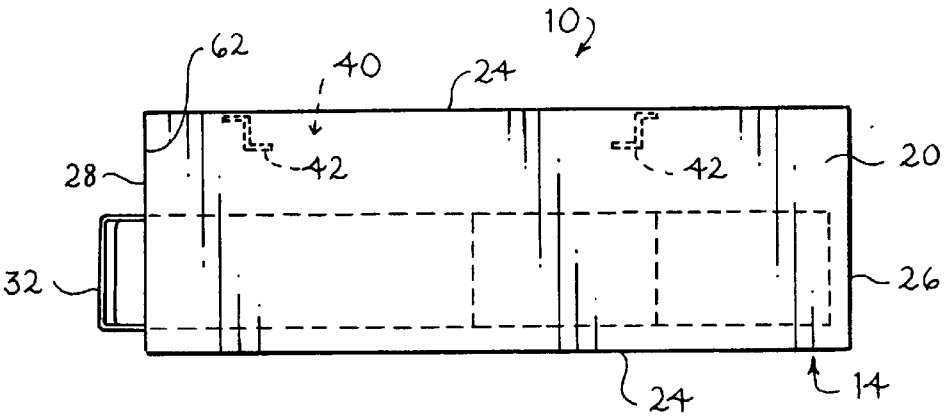
FIG. 4 is a plan view of the chilled condiment dispenser shown in FIG. 1.
Figure 2:
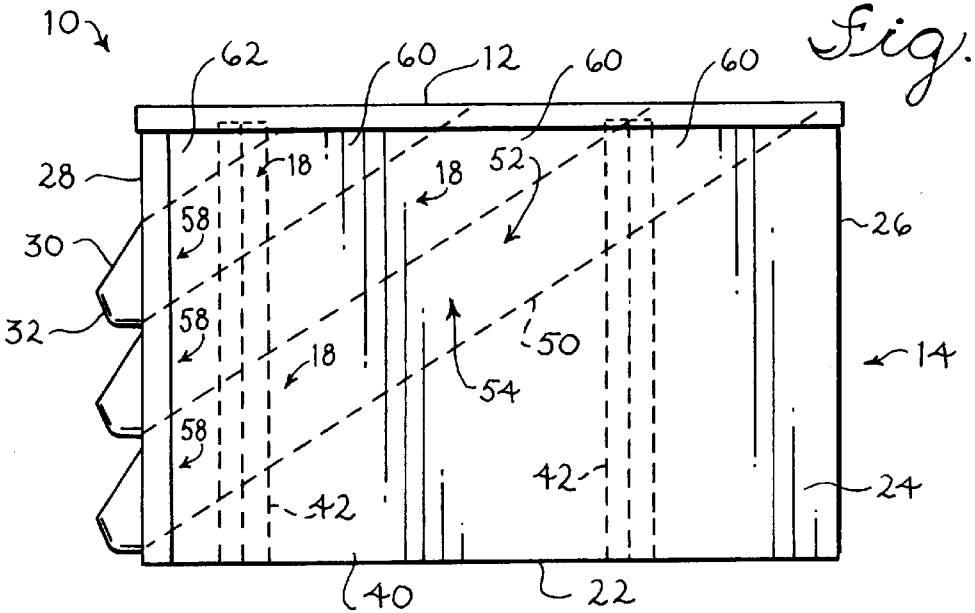
FIG. 2 is a side view of the chilled condiment dispenser shown in FIG. 1.
Figure 3:
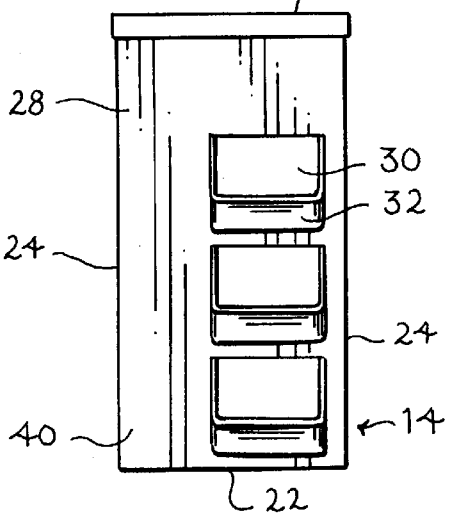
FIG. 3 is a front view of the chilled condiment dispenser shown in FIG. 1.

FIGS. 1–4 show different views of a preferred chilled condiment dispensing apparatus 10. This apparatus 10 comprises a removable lid 12, a cabinet 14, at least one cooling device 16 removably disposed therein and a plurality of removable chutes 18 (preferably one for each different type of chilled condiment 38 to be dispensed), stacked one above the other.

The removable lid 12 is preferably of a size and shape which fits securely over the top of the cabinet 14.

The cabinet 14 preferably comprises a bottom wall 22, two side walls 24, a back wall 26 and a front wall 28 having a plurality of openings 30 and corresponding protrusions 32 therein to permit access to the chilled condiments 38 from outside of the dispenser 10 by consumers. The size and shape of the openings 30 should conveniently permit access to a plurality of the chilled condiments 38. The openings 30 may be square, rectangular, oval, circular, triangular or of other shapes.

The protrusions 32 in the front wall 28 of the cabinet 14 are bin-like structures which hold chilled condiments 38 at the forward ends 58 of the chutes 18 to enable consumers to readily select and grasp a plurality of the condiment containers 38.

The cabinet 14 has at one of its sides 24 a narrow, compact side compartment 40 into which one or more cooling devices 16 may be removably disposed. The side compartment 40 in the illustrated embodiment is disposed along the entire side of the cabinet 14 so as to extend the full height and depth of the cabinet 14. In other embodiments, the separate side compartment 40 may be of other sizes and shapes.

Preferably, the side compartment 40 has a track or guide structure which facilitates loading and removal of cooling devices 16, and maintains the cooling devices in position within the side compartment 40. The illustrated guide structure comprises a pair of elongated bracket members 42 secured to the interior surface of the side wall 24. Each of the bracket members 42 has a generally L-shaped portion which engages a pair of stacked cooling devices so that the cooling devices are held securely against the side wall and constrained against horizontal displacement. The chutes 18 may be supported by inwardly-extending supports on the cabinet side walls 24 or by other arrangements.

The dispenser 10 preferably also includes a chute closure plate 44 which is movable between a horizontal position in which it covers a portion of the top of the cabinet 14, and a vertical position in which it slides downward along a track along the inside 62 of the front wall 28 of the cabinet 14, thereby closing off the openings 30 in the front wall 28 of the cabinet 14 to prevent condiment containers 38 from spilling out of the lower front ends 58 of the chutes 18 when the chutes 18 are being removed from the dispenser 10.

The chute closure plate 44 is preferably a thin, rectangular plate which has a width slightly less than the distance between the side walls 24 of the cabinet 14. However, the chute closure plate 44 may be of any size and shape which permits the chute closure plate 44 to perform the function described herein.

It is preferable that the cabinet 14 be made of a thermally-insulative material, so that the cabinet 14 can efficiently maintain a temperature differential without excessive formation of condensation on the outside surface of the cabinet 14.

While any suitable size, type or number of cooling devices 16 may be employed in the chilled condiment dispensers 10, the illustrated embodiment employs four cooling devices 16, each comprising a container of about seven inches by seven inches by two inches having a coolant gel or other coolant material therein, with two of the containers being stacked on top of the other two containers, such that the cooling devices 16 contact a substantial portion of one side of each of the chutes 18 and extend substantially the entire height of the cabinet 14. Preferably, each of the cooling devices 16 has a handle 48 at its upper end to enable the containers to easily be manually inserted into, and removed from, the side compartments 40 from above, with very little clearance between the cooling devices 16 and the chutes 18. The handle 48 may comprise, for example, a flexible strip of material having its opposite ends riveted to respective opposite ends of the cooling device 16.

Each of the removable chutes 18 preferably comprises a bottom wall 50 and a pair of side walls 52 defining an open-ended space for the storage of product 54. Each of the chutes 18 is positioned to slope downward toward the front wall 28 of the cabinet 14 such that each chute 18 has a lower front end 58 aligned with a respective one of the openings 30 in the front wall 28 of the cabinet 14, from which condiment containers 38 may be accessed by consumers from outside of the dispenser 10. Each of the chutes 18 has an upper rear end 60 into which chilled condiments 38 may be loaded for dispensing. The upper rear end 60 of each of the chutes 18 preferably is aligned with the top 20 of the cabinet 14.

The chutes 18 may also be made of any suitable material. In order to enable efficient transfer of heat to the cooling devices 16 in the separate side compartment 40, it is preferable that the chutes 18 be made of a thermally-conductive material. One particular example of a suitable material is a factory-finished aluminum composite material known as Apolic.

At the start of a period of use of the dispenser 10, the user will generally remove the lid 12 from the cabinet 14, remove the chute closure plate 44, and lower the chutes 18 into the cabinet 14. The chutes 18 may be pre-cooled by being stored in a refrigerator or other cool environment overnight. The user may then load chilled condiment containers 38 into the upper rear ends 60 of the chutes 18 from a refrigerator or other cool environment.

Either prior to, or after, loading chilled condiments 38 into the chutes 18, one or more cooling devices 16, such as ice packs, will be placed into the side compartment 40. The user will place the chute closure plate 44 back into a horizontal position, and replace the removable lid 12.

As the supply of chilled condiments 38 present in the cabinet 14 becomes depleted, the user may remove the lid 12 from the cabinet 14, lift the chute closure plate 44, and refill the chutes 18 by loading the chilled condiment containers 38 into the upper rear ends 60 of the chutes 18 while the chutes 18 remain in the cabinet 14. The cooling devices 16 in the side compartments 40 of the cabinet 14 may also be removed and replaced as necessary.

At the end of a period of use, the chilled condiments 38 may be removed from the cabinet 14 for overnight refrigerated storage. The user may sequentially close the openings 30 by manually pushing the condiment containers 38 in the protrusions 32 back into the lower front ends 58 of the corresponding chutes 18, then lowering the chute closure plate 44 to cover the openings 30 and the open front ends 58 of the chutes 18, beginning with the uppermost chute 18 and proceeding downward. One at a time, starting with the uppermost chute 18 and proceeding downward, each chute 18 is then lifted from a downwardly-sloping position to a generally horizontal position. The open front end 58 of the chute 18 is slid upward along the chute closure plate 44 which faces the chute 18, such that the chute closure plate 44 constrains condiments 38 from spilling out of the open front end 58 of the chute 18 as the chute 18 is being pulled upwards. The chute 18 is then lifted upward and out of the cabinet 14. The condiment containers 38 may then be removed from the chute 18, or may remain in the chute 18, and placed into a refrigerator for overnight storage.

Although certain preferred embodiments of the chilled condiment dispensers of the present invention have been shown and described herein, those of ordinary skill in the art will recognize numerous variations, modifications and substitutions which may be made, as by adding, combining, subdividing parts, or by substituting equivalents. Thus, the invention is not limited to the preferred embodiment described herein.

What is claimed is:

1. A self-serve chilled condiment dispenser for cooling and dispensing individual containers of condiments, said dispenser comprising:

(a) a removable lid;

(b) a cabinet, said cabinet having an open top, a bottom wall, two side walls, a back wall and a front wall having a plurality of openings therein, having space for the storage of product, and having a narrow side compartment;

(c) at least one compact cooling device removably disposed within said side compartment; and (d) a plurality of removable chutes, each of said chutes having a bottom wall and two side walls, having space for the storage of product, and being positioned to slope downwardly toward said front wall of said cabinet so that each chute has a lower front end aligned with a respective one of said openings and an upper rear end which may receive product for dispensing;

said apparatus permitting the access of product generally on a first in, first out basis; each of said chutes comprising a thermally conductive material which conducts heat from said condiment containers to said side compartment to effect cooling of said condiment containers without direct contact between said condiment containers and said at least one cooling device.

2. A dispenser in accordance with claim 1 wherein each cooling device comprises a container, a coolant material disposed within said container, and a handle attached to an upper portion of said container to enable said container to be removed manually from said side compartment from above without requiring clearance between said cooling device and the compartment interior.

3. A dispenser in accordance with claim 2 wherein four of said cooling devices are removably disposed within said side compartment.

4. A dispenser in accordance with claim 3 wherein two of said cooling devices are positioned on top of the other two of said cooling devices.

5. A dispenser in accordance with claim 1 wherein said front wall additionally has a plurality of protrusions therein.

6. A dispenser in accordance with claim 1 further comprising a chute closure plate which selectively covers said openings.

7. A dispenser in accordance with claim 1 wherein said side compartment has a track for said cooling device.

8. A dispenser in accordance with claim 1 wherein said dispenser has three chutes.

9. A dispenser in accordance with claim 1 wherein said cabinet is made from a thermally insulative material.

10. A dispenser in accordance with claim 9 wherein said chutes are made from an aluminum composite material.

11. A dispenser in accordance with claim 10 wherein said chutes are made from Apolic.

12. A dispenser in accordance with claim 1 wherein said front wall additionally has a plurality of protrusions, said cabinet additionally has a chute closure plate which selectively covers said openings, said dispenser has three chutes, said cabinet is made from a thermally insulative material and said chutes are made from an aluminum composite material.

13. A dispenser in accordance with claim 12 wherein each cooling device comprises a container, a coolant material disposed within said container, and a handle attached to an upper portion of said container to enable said container to be removed manually from said side compartment from above without requiring clearance between said cooling device and the compartment interior.

14. A dispenser in accordance with claim 13 wherein said side compartment has a track for said cooling device.

15. A dispenser in accordance with claim 14 wherein four of said cooling devices are removably disposed within said side compartment.

16. A dispenser in accordance with claim 15 wherein two of said cooling devices are positioned on top of the other two of said cooling devices.

17. A dispenser in accordance with claim 16 wherein said chutes are made from Apolic.

* * * * *